United States Patent [19]

Steinberg

[11] Patent Number: 4,589,929

[45] Date of Patent: May 20, 1986

[54] METHOD FOR TREATING THE SURFACE OF FINISHED PARTS, PARTICULARLY THE SURFACE OF TUBES AND SPACERS FORMED OF ZIRCONIUM ALLOYS, FOR NUCLEAR REACTOR FUEL ASSEMBLIES

[75] Inventor: Eckard Steinberg, Erlangen, Fed. Rep. of Germany

[73] Assignee: Kraftwerk Union Aktiengesellschaft, Mülheim, Fed. Rep. of Germany

[21] Appl. No.: 578,547

[22] Filed: Feb. 9, 1984

[51] Int. Cl.[4] ..... C23F 7/02

[52] U.S. Cl. ..... 148/6.3; 376/305

[58] Field of Search ..... 148/6.3; 376/305

[56] References Cited

U.S. PATENT DOCUMENTS

| | | | |
|---|---|---|---|
| 2,987,352 | 6/1961 | Watson | 148/6.14 R |
| 3,556,870 | 1/1971 | Debray | 376/305 |
| 3,615,885 | 10/1971 | Watson | 148/6.3 |
| 3,669,758 | 5/1972 | Konecny | 148/6.14 R |

FOREIGN PATENT DOCUMENTS

| | | | |
|---|---|---|---|
| 1299480 | 3/1964 | Fed. Rep. of Germany | 148/6.3 |
| 1621420 | 5/1971 | Fed. Rep. of Germany | 376/305 |
| 1534461 | 8/1968 | France | 148/6.3 |

*Primary Examiner*—Sam Silverberg

*Attorney, Agent, or Firm*—Herbert L. Lerner; Laurence A. Greenberg

[57] ABSTRACT

A method for treating the surface of finished parts formed of zirconium alloys for nuclear reactor fuel assemblies with an oxidizing agent, includes heating the finished parts in an autoclave and subjecting the finished parts to an oxidizing agent sufficient to generate oxygen in atomic form and to form a substantially hydrogen-impervious surface layer of oxide at least on the surface portions of the finished parts which are subjected to water or steam in the nuclear reactor.

2 Claims, No Drawings

METHOD FOR TREATING THE SURFACE OF FINISHED PARTS, PARTICULARLY THE SURFACE OF TUBES AND SPACERS FORMED OF ZIRCONIUM ALLOYS, FOR NUCLEAR REACTOR FUEL ASSEMBLIES

The invention relates to a method of treating the surface of finished parts with an oxidizing or oxidation agent, particularly the surface of tubes and spacers formed of zirconium alloys, for nuclear reactor fuel assemblies.

Such a method is known from page 158 of the publication "Nuclear Engineering and Design" 33 (1975), published by North-Holland Publishing Company. According to this prior art method, cladding tubes for nuclear reactor fuel, which are formed of a zirconium alloy referred to as "Zircaloy", are given an etching treatment, and are subsequently exposed to an oxidizing agent formed of water or steam for three days at 300° C. to 400° C. and the cladding tube surface is subsequently examined for faults and pickling residues by means of the surface layer of oxide which is formed. However, it is a disadvantage of this method that it causes a great deal of local nodular corrosion of such surfaces.

It is accordingly an object of the invention to provide a method for treating the surface of finished parts, particularly the surface of tubes and spacers formed of zirconium alloys, for nuclear reactor fuel assemblies, which overcomes the hereinafore-mentioned disadvantages of the heretofore-known methods of this general type, and to avoid heavy local corrosion (nodular corrosion) on surfaces of finished parts, such as cladding tubes formed of zirconium alloys for nuclear reactor assemblies, which may occur, for instance, on the outer surface of cladding tubes once these cladding tubes are filled with nuclear fuel and are exposed with their outer surface to superheated water or steam in a nuclear reactor. Nodular corrosion can lead to the perforation of the finished parts which are made of a zirconium alloy, such as the cladding tubes of a nuclear reactor.

With the foregoing and other objects in view there is provided, in accordance with the invention, a method for treating the surface of finished parts, especially the surface of tubes and spacers, formed of zirconium alloys for nuclear reactor fuel assemblies with an oxidizing agent, which comprises heating the finished parts to such a temperature in an autoclave and subjecting the finished parts to such an oxidizing agent sufficient to generate oxygen in atomic form and to form a substantially or very largely hydrogen-impervious surface layer of oxide at least on the surface portions of the finished parts which are subjected to water or steam in the nuclear reactor.

While further oxidation of the zirconium alloy in superheated water or steam in the nuclear reactor is not prevented, the penetration of hydrogen into the matrix of the zirconium alloy which would locally hydrogenize the zirconium alloy, is avoided. Therefore, the oxide layer cannot be perforated at the surface of the finished parts, so that superheated water or steam cannot react in the nuclear reactor directly with the zirconium alloy, forming corrosion blisters (nodular corrosion).

In accordance with another mode of the invention, there is provided a method which comprises heating the finished parts in the autoclave until a surface layer is oxidized on the finished parts having a thickness sufficient to cause secondary precipitates located in the surface layer to be completely surrounded by oxide. The secondary precipitates are undissolved alloy components in the matrix of the zircomium alloy which improve the technological properties of the alloy such as their hardness and strength, for example, and which exhibit a corrosion behavior different from the matrix of the zirconium alloy, allowing them to form windows in the hydrogen-impermeable surface layer oxide. Superheated water or steam would likewise react directly with the zirconium alloy through such windows in a nuclear reactor and trigger secondary precipitation. If the secondary precipitations are completely surrounded by hydrogen-impervious oxide, the development of such windows is prevented.

In accordance with a further mode of the invention, there is provided a method which comprises oxidizing a surface layer substantially from 1 to 3 μm thick.

In accordance with an added mode of the invention, there is provided a method which comprises using hydrogen peroxide ($H_2O_2$) as the oxidizing agent.

In accordance with an additional mode of the invention, there is provided a method which comprises heating the finished parts and the $H_2O_2$ in the autoclave to a temperature substantially in the range from 400° C. to 550° C.

In accordance with a concomitant mode of the invention, there is provided a method which comprises using ozone as the oxidizing agent.

German Pat. No. DE-PS 27 37 532 corresponding to U.S. Pat. No. 4,411,861, describes a method of generating an oxide surface layer on the inside of cladding tubes for fuel rods of nuclear reactor assemblies, which are formed of a zirconium alloy. The oxide surface layer is generated by evaporating $H_2O_2$ in cladding tubes which are closed at both ends and are stretched or bloated. However, this oxide surface layer is not generated in the outer surface of the cladding tubes which is subjected to water or steam in a nuclear reactor, but is instead on the inside surface which is not subjected to water or steam. Accordingly, this oxide layer on the inside of the cladding tubes also does not prevent nodular corrosion caused by superheated water or steam in a nuclear reactor, but is rather provided to prevent stress corrosion due to nuclear fission products.

The invention and its advantages will be explained with the aid of the following examples:

According to a first example, a cladding tube formed of a zirconium alloy known as Zircaloy 2, which contains 1.2 to 1.7 percent tin by weight; 0.07 to 0.2 percent iron by weight; 0.05 to 0.15 percent chronium by weight; 0.03 to 0.08 percent nickel by weight; 0.07 to 0.15 percent oxygen by weight; and the remainder zirconium, is oxidized on the outside in an autoclave for three days, in steam at 400° C. This results in a surface layer of oxide, which is 1 to 2 μm thick. This cladding tube is subsequently exposed to steam at 500° C. and at a pressure of 125 bar for 24 hours, in another autoclave which simulates the conditions in a nuclear reactor. The weight increase of the tube is 1200 mg per $dm^2$ of the outer surface, after this period of time. Furthermore, numerous corrosion blisters are formed on the outer surface.

According to a second example, a cladding tube of the same zirconium alloy is subsequently heated for 72 hours to 400° C. in an autoclave which contains 40% hydrogen peroxide ($H_2O_2$). A surface layer which is 1 to 3 μm thick is oxidized on the outer surface of the cladding tube. This cladding tube is then subjected to the same test conditions as in the first example, in another autoclave in which the conditions in a nuclear reactor are simulated. A weight increase of only 50 mg per $dm^2$ of the outer surface is obtained. The surface layer of oxide is black without shading and free of corrosion blisters (it has no nodular corrosion).

It is advantageous to heat the finished parts formed of zirconium alloys and the hydrogen peroxide ($H_2O_2$) in the autoclave to a temperature in the range of 400° C. to 550° C. Instead of hydrogen peroxide ($H_2O_2$), ozone may be advantageously used as the oxidizing agent in the autoclave.

The foregoing is a description corresponding in substance to German Application No. P 33 05 730.3, filed Feb. 18, 1983, the International Priority of which is claimed for the instant application, and which is hereby made part of this application. Any material discrepancies between the foregoing specification and the aforementioned corresponding German application are to be resolved in favor of the latter.

I claim:

1. Method for treating the surface of finished parts formed of zirconium alloys for nuclear reactor fuel assemblies with an oxidizing agent, which comprises heating the finished parts in an autoclave and subjecting the finished parts to hydrogen peroxide ($H_2O_2$) as an oxidizing agent sufficient to generate oxygen in atomic form and to form a substantially hydrogen-impervious surface layer of oxide at least on the surface portions of the finished parts which are subjected to water or steam in the nuclear reactor, and heating the finished parts and the $H_2O_2$ in the autoclave to a temperature substantially in the range from 400° C. to 550° C.

2. Method according to claim 1, which comprises heating the finished parts in the autoclave until a surface layer substantially from 1 to 3 $\mu$m thick is oxidized on the finished parts having a thickness sufficient to cause secondary precipitates located in the surface layer to be completely surrounded by oxide.

* * * * *